United States Patent [19]

Morandi et al.

[11] Patent Number: 4,653,126

[45] Date of Patent: Mar. 31, 1987

[54] TOILET BOWL WITH MEANS FOR HOT WATER DISTRIBUTION FOR WASHING AND HOT AIR FOR SUBSEQUENT DRYING

[76] Inventors: Cesare Morandi, Viale Cialdini 4; Enrico Parigi, Piazza San Gervasio 4, both of Firenze, Italy

[21] Appl. No.: 661,421

[22] Filed: Oct. 16, 1984

[30] Foreign Application Priority Data

Oct. 21, 1983 [IT] Italy ..... 9543 A/83

[51] Int. Cl.[4] ..... F03D 9/08

[52] U.S. Cl. ..... 4/420.2; 4/420.5

[58] Field of Search ..... 4/420.1–420.5, 4/443–448; 165/163

[56] References Cited

U.S. PATENT DOCUMENTS

| | | | |
|---|---|---|---|
| 3,154,793 | 11/1964 | Congdon | 4/420.2 |
| 3,247,524 | 4/1966 | Umann | 4/447 |
| 3,662,407 | 5/1972 | Colucci | 4/420.2 |
| 3,925,826 | 12/1975 | Huyot et al. | 4/420.4 |
| 4,062,071 | 12/1977 | Blanquet | 4/420.2 |
| 4,087,868 | 5/1978 | Gentz | 4/447 |
| 4,237,560 | 12/1980 | Riegelman et al. | 4/420.2 |
| 4,372,372 | 2/1983 | Hunter | 165/163 |
| 4,450,596 | 5/1984 | Cohen | 4/447 |

FOREIGN PATENT DOCUMENTS

| | | | |
|---|---|---|---|
| 89416 | 4/1937 | Sweden | 4/420.4 |

*Primary Examiner*—Stephen Marcus
*Assistant Examiner*—Linda J. Sholl
*Attorney, Agent, or Firm*—McAulay, Fields, Fisher, Goldstein & Nissen

[57] ABSTRACT

A toilet bowl provided with a hot water spray for washing after relieving a bodily need and a hot air blower for subsequent drying of the washed portion of the body. A rapid heat exchanger to heat the water is provided with several tubes arranged in groups of concentric spirals at a radial distance from one another, inside a tubular chamber in which the hot air intended for drying is electrically heated and blown to flow along the tubes. The rapid heat exchanger can either be housed in a space in the bowl or in a fixed part of the seat.

8 Claims, 12 Drawing Figures

TOILET BOWL WITH MEANS FOR HOT WATER DISTRIBUTION FOR WASHING AND HOT AIR FOR SUBSEQUENT DRYING

BACKGROUND OF THE INVENTION

The invention concerns a toilet bowl comprising means to supply a hot water spray for washing after relieving a bodily need and a hot water jet for subsequent drying of the washed part of the body. There are known toilet bowls of this general type but they either do not provide for a heating of the water or require an additional water heater which considerably complicates their installation.

OBJECTS AND FEATURES OF THE INVENTION

The principal purpose of the present invention is to eliminate the above drawbacks by means of a simple and economical device. This is achieved according to this invention by heating the water for washing by means of a rapid heat exchange device with an electrically-heated air jet intended for drying, which comprises numerous small-section and thin-walled tubes arranged along several concentric coils, in which the heated air moves parallel to the axis of the coils and flows along the surface of the tubes 5 device is installed either within the body of the bowl or otherwise inside a fixed part of a toilet seat.

The advantages obtained thanks to the invention essentially consist in: that the hot water is directly and independently obtained within the bowl itself or in its seat, that the heating of the water is very rapid, so that the device is always operational, even for several consecutive operations; that the timing of each operation is programmed; that the device can be installed on any already existing toilet bowl and permits easy maintenance operations without removing the bowl; that the installation cost and operating cost are much lower than those of similar bowls presently known; and that operation is simple and safe and offers high reliability even after long periods of operation.

BRIEF DESCRIPTION OF THE DRAWINGS

The invention will now be described in greater detail with the aid of the attached drawings, showing two possible embodiments of the invention.

DESCRIPTION OF THE BEST MODES OF THE INVENTION

In FIGS. 5 through 10 and 10A, the reference numbers to indicate similar or identical parts are the same as those in FIGS. 1 through 4 and 4A.

Figure 1:
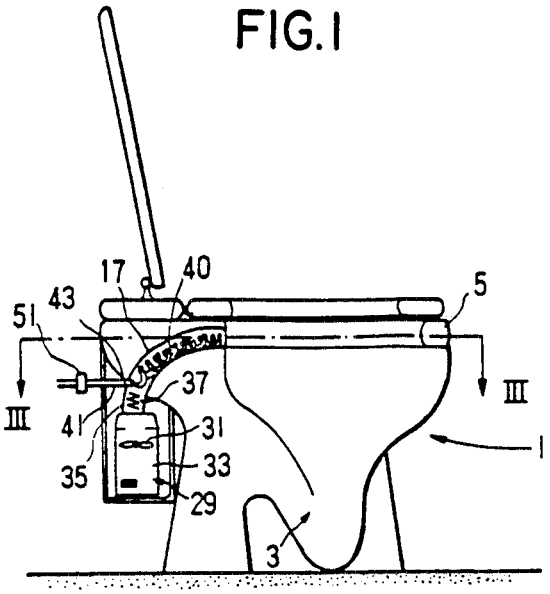
FIG. 1 shows a schematic side section view of a toilet bowl according to the invention.
Figure 2:
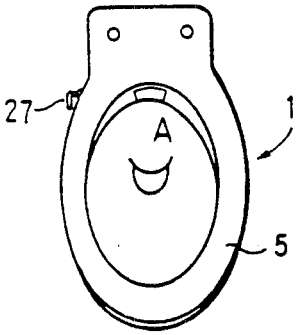
FIG. 2 shows a plan view of the bowl with the seat assembly removed.
Figure 3:
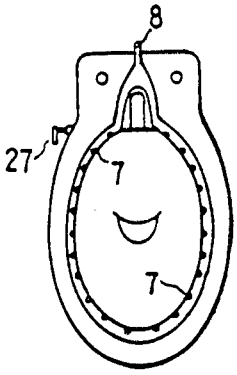
FIG. 3 shows a section view taken along the III—III in FIG. 1.
Figure 4:
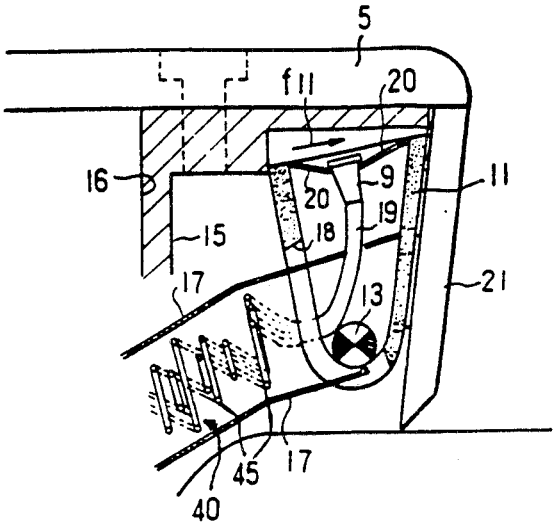
FIGS. 4 and 4A show enlargements of the sectional views of detail A in FIGS. 1 and 2, respectively, in two different positions, at rest or operating.
Figure 4A:
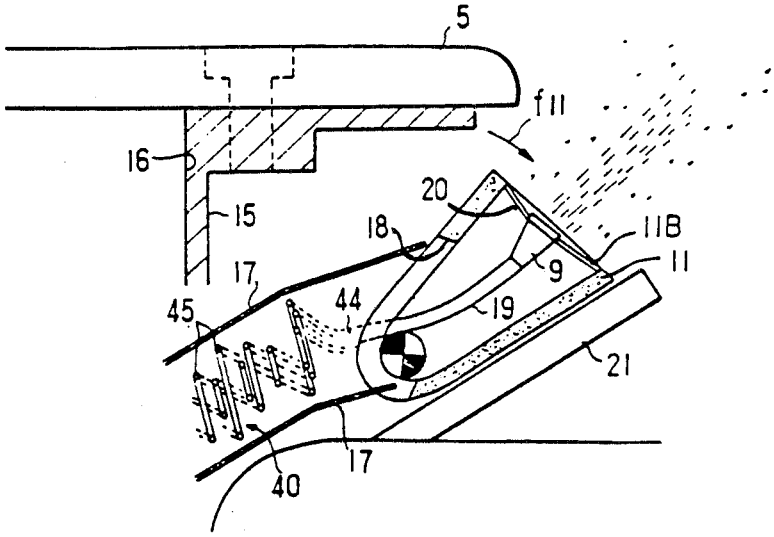
Figure 5:
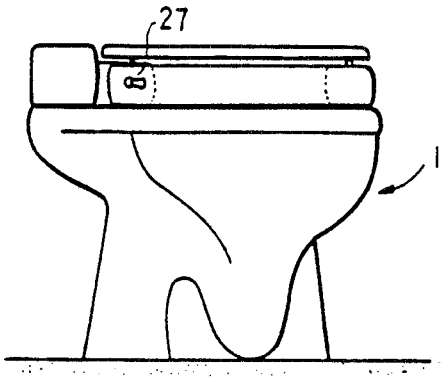
FIG. 5 shows a side view of a bowl according to the invention with the device comprising the means for heating the water for washing and the air for drying housed inside the fixed part of the seat.
Figure 7:
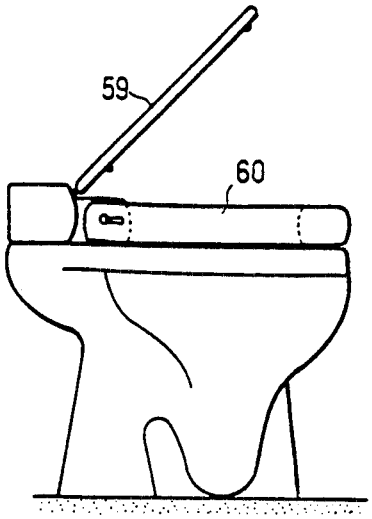
FIGS. 7 and 8 each show a side view of the bowl in FIG. 5, one with both the cover lifted and the other with the cover and the seat lifted.
Figure 6:
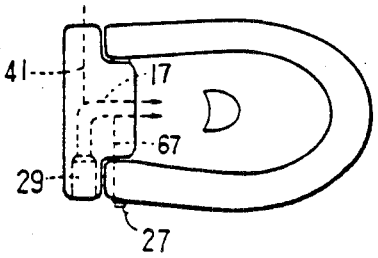
FIG. 6 shows a plan view of the bowl, but with the seat cover removed.
Figure 8:
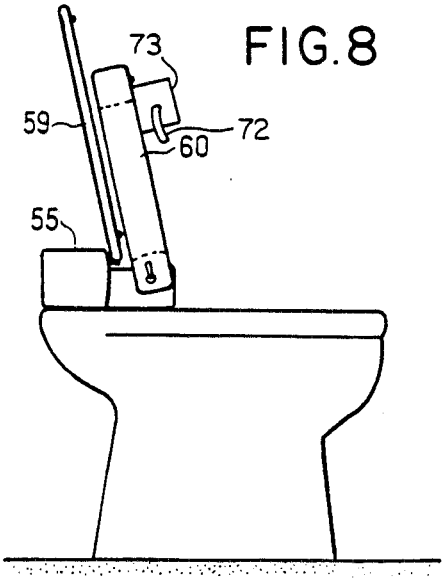
Figure 9:
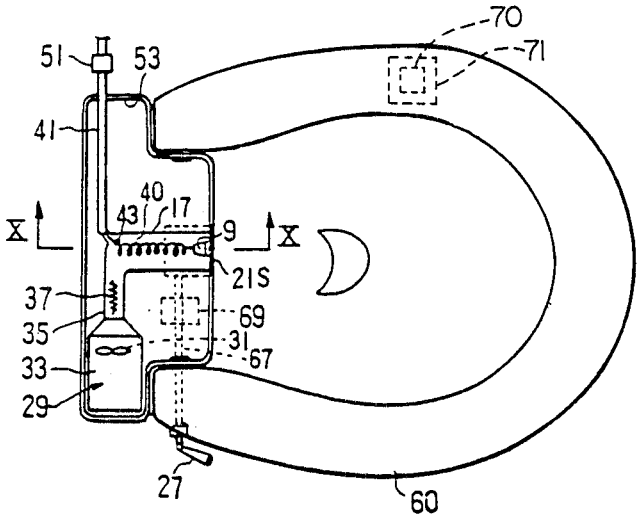
FIG. 9 shows a schematic section view taken along a horizontal plane of the bowl seat in FIG. 5.
Figure 10A:
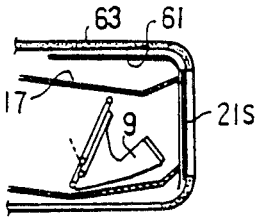
FIGS. 10 and 10A each show enlarged schematic views taken along line X—X in FIG. 9, the two views differing from each other with respect to the position of the closing device.
Figure 10:
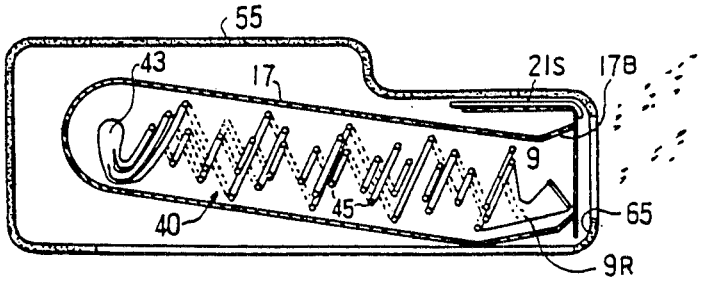

As shown in the attached drawings, the bowl according to the invention, shown as a whole as 1, comprises, as usual, a siphon 3 for water shutoff and an edge 5 provided with holes 7 underneath for letting the water arriving from a pipe 8 out of the flushing system; it further comprises, in a known manner, arranged approximately at the rear end of the longitudinal axis of the bowl, means capable of ejecting upward and in an oblique direction a hot water spray—for washing after relieving a bodily need—and a hot air jet or blower for subsequent drying. As shown in FIGS. 1, 4 and 4A, the means are composed of a shower (or sprinkler) element 9 for supplying the hot water and the mouth of an element 11 which is approximately wedge-shaped, that is, with sector-shaped walls, and is articulated at 13 with the walls of its own box-shaped housing 15, fixed, in a rear position, in a space 16 under the edge 5 of the bowl.

Element 11 communicates with the front end of a hot air feed pipe 17, through a slit 18 cut in its rear wall, the pipe 17, in inoperative position, projecting beyond the slit 18. Inside the element 18 there is a pipe 19 into which the hot water arrives, which has at its end the shower element 9 and is made flexible to give it angular motion, in the direction of arrow f11 (or in the opposite direction) of the element 11. The slower element 9 is connected, by means of small rods 20, to the walls of element 11, so as to be capable of moving with it, while a closure plate 21, integral in front with element 11, completes the wall of the bowl when, in a vertical position, it closes the housing 15 concealing element 11. Plate 21 is attached by means of screws or otherwise to the front wall of element 11, from which it projects below to act also as a closure of the space 16 obtained in the body of the bowl 1. When element 11 and plate 21 are rotated in the direction of arrow f11, they assume the operating position shown in FIG. 4A, that is, the position in which the shower element 9 sprays hot water for washing and the mouth 11B of element 11 emits hot air for drying. The angular motion of element 11—and therefore of plate 21—is controlled by a rod whose end, generally square in section, is inserted into a hole 25, also square, in a side wall of element 11 and is operated by a handle lever 27 placed on one side outside the bowl 1 (see FIGS. 2 and 3). The operation of the lever 27 also activates the electric controls (not shown) as a result of which the devices for the hot water and air for washing and drying, respectively, are made available to start operating. Typically, according to the invention, the heating, up to approximately body temperature, of the water intended for washing—which is normal cold water originating from the home water system—takes place by means of a rapid heat exchange between the hot air which will be used for drying and the cold water, the exchange occurring upstream from the outlet 11B. The air for the exchange first and for drying thereafter is drawn in from the room and then blown at high speed and also heated to a relatively high temperature by a device 29, structured like a common hair dryer, in which a propeller blower 31, powered by a small electric motor 33, blows the air into a tube 35, through a coil of electric resistors 37; coil 37 is wound around a refractory insulating support located axially inside the tube 35. After passing through the coil of electric resistors 37, the air—which is heated to approximately 80°-90° C.—continues inside the pipe 17, into which tube 35 extends, which constitutes the housing of the actual heat exchanger. This exchanger, which now will be described in detail, shows special features which make it suitable to achieve the purposes of the invention.

Through a side hole there enters approximately up to the middle of pipe 17 a cold water feed pipe 41, which ends with a head 43 to subdivide the flow provided by pipe 41 into partial flows which follow a number of tubes 45 of relatively small diameter and having thin walls to faciliate the heat exchange. The tubes 45 are of considerable length, but, to reduce bulk in the axial direction and to increase the area of the exchange surface, they are arranged within the pipe 17 so as to form a group 40 of concentric coils; with this arrangement, provision is made for suitable radial distances between the coils of a spiral and those of the spirals farther inside and/or outside relative to it; furthermore, a suitable radial distance is left between the farthest outside coil and the wall of pipe 17, and the inside diameter of the innermost coil is suitable to permit the passage of a considerable portion of the hot air blown by device 29. The ends of the tubes 45 opposite to those which originate from the head 43 are joined together, after the concentric coils, in a further manifold head 44, on a short projection of which is inserted the flexible hose 19, which has at the opposite end the element 9. As a result of the subdivision of the flow supplied by the pipe 41 into a certain number of partial flows, of the relatively low velocity of the water inside the tubes 45, of their thinness and of their material which has high heat conductivity (such as copper) in the walls of the tubes, and especially because of the large surface which, being arranged in concentric spirals, they present to the very hot air which flows along them, being forced to flow through the spaces among them, a heat exchange between hot air and water which is very effective and starts rapidly. Consequently, the air, initially at 80°-90° C. after its passage through the assembly 40, exits at a reduced temperature, namely at approximately 40°-50° C., whereas the water is supplied by element 9 at a temperature of 37°-38° C., which is very close to body temperature.

To obtain this result, a water pressure reducer 51, located upstream of the cold water feed pipe 41, capable of permitting the passage of an approximately constant flow of water through the tubes 45, is appropriately combined with the apparatus composed of the device 29 supplying hot air and the assembly of pipe 17 with inside it the heat exchanger group 40 of thin tubes in concentric coils. The opening through which pipe 41 enters inside pipe 19 is sealed outside the pipe so as to avoid leaks of unheated outside air into said pipe. Pipe 17 may have a curved shape, as shown in FIG. 1, but can also be made straight, thereby facilitating manufacture of the assembly. Similarly, the device 29 to draw air from the room, blow it and heat it may be arranged and oriented in a different position from the vertical shown, by way of example, in FIG. 1. In any case, the assembly composed of device 29 and pipe 17, which contains the heat exchanger formed by group 40 can be regarded as a "combined apparatus", adaptable, by varying the relative arrangement of its components, to the bowls to which it must be applied.

For the proper operation of the bowl according to the invention, and particularly of the assembly to heat the water for washing, provision is made, according to criteria known to experts in the art, for the installation of the following devices: upstream of the pipe 41 and pressure reducer 51 a one-way valve, an opening and closing electric valve and a demineralizing filter. Furthermore, the electric circuit in the apparatus comprises a suitable timer, which at the beginning of the cycle sets the opening of the water which a few moments after the flow of heated air inside pipe 17 has started, so as to avoid that the water for washing be initially cold and to cause the heat exchange to heat it as soon as it starts passing through the tubes 45. The timer also, after a certain period of time, sufficient for washing, shuts off the supply of heated water and, simultaneously with the shutoff operation, reduces by switching or otherwise the power of the electric heating resistors; this is done for economy and also to prevent the heated air, which continues to be supplied, from tending to reach excessive temperatures, both for the user and for the tubes in the exchanger, since the heat exchange between incoming hot air and cold water comes to an end. After a further period of time, during which the hot air continues to be supplied for drying, the timer also shuts off the hot air jet and restores the initial condition of the circuit. The use of the timer can make it possible to vary the duration of the washing and drying operations at the time of installation or final testing of the apparatus, or also to adjust to changing seasonal conditions. For this latter purpose, it is possible to use a Summer-Winter switch, capable of changing the duration of washing and drying, respectively, in the two different seasons, by acting upon the timer. Provision is also made for the installation of a thermostat to control the temperature of the air downstream from assembly 40, so that it will not exceed 40°-45° C., and also for the installation of a maximum temperature thermostat midway between the heads 43-44, as well as a safety thermostat in contact with head 44, to make sure that the water temperature will not reach dangerous levels.

With reference to FIGS. 5 through 10 and 10A, the means to supply the hot water spray for washing and the hot air jet for drying, as well as the apparatus for obtaining the heated water and air, are installed, instead of in the body of the bowl, in a space 53 provided inside the fixed portion 55 of the seat assembly 57, to which portion both the actual seat 60 and the cover 59 are hinged, so that they can be lifted. The fixed portion 55 may, if necessary, project a little behind the bowl, without, however, requiring to move forward a bowl already installed, in case of retrofitting of this special seat assembly. Also in the modification described in FIGS. 5 through 10 and 10A, the device 29, of the hair dryer type, blows air onto a group of resistors 37 inside pipe 35, which communicates with pipe 17, inside which is located the group 40 of tubes 45 arranged in concentric coils, which originate from a head 43 to subdivide the flow and are reconnected at 9R, that is, at the base of the shower element 9. Element 9 is inclined upward by in a suitable way for washing. Head 43 is located at the end of the cold water feed pipe 41, which enters into pipe 17 approximately up to its center and at the beginning of it. On pipe 41 there is, together with the other devices, such as pressure reducer 51 and the demineralizing filter, an opening and closing electric valve. Inside pipe 17 takes place heat exchange between the hot air which exits downstream from resistors 37 and the water which arrives cold at head 43 and flows inside the tubes 45. The hot air, which reaches assembly 40 at a temperature of 80°-90°, following the active heat exchange, exits outlet 17B at 40° C., which is a suitable temperature for drying. In the modification described in FIGS. 5 through 10 and 10A, the shutting off of the hot air outlet 17B, and thereby the concealment of element 9—to avoid its being soiled or otherwise—takes place by means of a flexible element 21S, of the sluice gate type. Element 21S in the opening position is housed (see FIG. 10) in a cavity 61 made under the wall 63 of portion 55 where the portion is lower to support the cover 59; from the opening position, which is reached by operating the lever 27, by which it is controlled, through a rack or similar mechanism, element 21S is moved to the closing position shown in FIG. 10A, by a reverse movement of lever 27, sliding within appropriate vertical guides 65. Through rod 67, which, by means of lever 27, controls the movement of element 21S, it is possible to operate the electric controls of the entire device, located in a box 69, the rod 67 being schematically shown as passing through box 69. Rod 67 is coaxial with the means for hinging the seat 60, resulting in a considerable simplicity of construction. Similarly, the cover 59 is level with the higher rear part of portion 55, for a better aesthetic appearance of the system. Both in the case in which the apparatus to generate hot air and to supply hot water by heat exchange is installed inside the bowl 1 and in the case of the variant in FIGS. 5 through 10 and 10A, provision is made for a microswitch 70, incorporated, for example, in one of the small feed 71 (shown in outline supporting the seat on the edge of the bowl, or operated by a small rod 72 near such a small foot 73, to electrically control the operation of the entire device, to prevent it from being operated in the absence of the user, and supplying water which, in the presence of the closing elements 21 and 21S, respectively, would not fall back into the bowl.

We claim:

1. A system for supplying a hot water spray to a toilet bowl for hygenic washing and for supplying hot air for subsequent drying and for supplying flushing water, comprising:

said toilet bowl including means to support a seat and being provided with flushing openings through which flushing water is supplied from a single water source;

means including tubes hving air heating, aspirating and blowing means therein associated with said toilet bowl and connected with said single water source for supplying thereto hot water for washing and hot air supply means for drying;

heat exchanger means for receiving water in said tubes and connected with said single water source enclosed with and including said tubes for heating the water, said heat exchanger means including a chamber surrounding and enclosing said tubes and associated with said hot air supply means for heating air blown past said others of said tubes, said tubes being of small section having thin walls and forming several groups of concentric spirals at a radial distance from one another to leave a space between adjacent tubes and said chamber surrounding said several groups of concentric spirals of tubes, said chamber being substantially coaxial with said tubes and said tubes being spaced from each other to permit the passage of the hot air in the space between adjacent tubes and between said tubes and said coaxial chamber for heating the water flowing through said tubes;

said air blowing means effecting hot air movement for blowing the hot air, supplied by said hot air supply means, through said chamber and around said tubes for flowing therearound and along each said feed tube;

separate water siphon means to effect removal of dirt products from said toilet bowl; and a wedge-shaped element for pivotal movement relative to said toilet bowl from an active to an inactive position, so that when rotated to the active position, the wedge-shaped element orients the water and hot air in the inside of a cup to provide for the closing and protection of the water and air feed area, and a handle lever located outside said toilet bowl for rotation of said wedge-shaped element.

2. The system of claim 1, including a flexible hose connected to said wedge-shaped element rotatable approximately in the center thereof.

3. The system of claim 1, wherein said toilet bowl has a rim and includes said flushing openings under said rim beneath the support for the seat thereof, the flushing water being supplied through said flushing openings in said toilet bowl.

4. The system of claim 1, including a seat and a fixed part associated with said seat on said toilet bowl, and said hot water supply means and said heat exchanger means being contained within said fixed part.

5. The system of claim 4, including a lever external of said seat, a hinge for hinging said seat to said toilet bowl, sluice gates juxtaposed to said hot air and said hot water outlets, and a lever located outside said seat and connected with said rod for operation of said sluice gates for opening and closing thereof.

6. The system of claim 1, including a microswitch operative to activate said heat exchanger when said seat is lowered and bears the weight of the user of the bowl.

7. The system of claim 1, including a water pressure reducer associated with said single water source and said tubes for assuring an approximate constant flow of water, and a timer which at the beginning of a wash cycle sets the flow of water a few moments after beginning of operation of said blowing means to cause said heat exchanger means to heat the water when it is received in said tubes.

8. The system of claim 1, wherein said toilet bowl has a rim and includes said flushing openings under said rim beneath the support for the seat thereof, the flushing water being supplied through said flushing openings in said toilet bowl.

* * * * *